United States Patent [19]

Zierhut

[11] 4,442,565

[45] Apr. 17, 1984

[54] PORTABLE POCKET CLOTHES BRUSH

[75] Inventor: Clarence D. Zierhut, Richardson, Tex.

[73] Assignee: Clarence Zierhut Incorporated, Richardson, Tex.

[21] Appl. No.: 414,351

[22] Filed: Sep. 2, 1982

[51] Int. Cl.[3] ..... A46B 13/08

[52] U.S. Cl. ..... 15/27; 15/25

[58] Field of Search ..... 15/23, 24, 25, 26, 27, 15/104 A, 184, 185; 401/269

[56] References Cited

U.S. PATENT DOCUMENTS

| | | | |
|---|---|---|---|
| 749,727 | 1/1904 | Fredricks | 15/27 |
| 1,590,267 | 6/1926 | Trester | 15/185 |
| 3,061,856 | 11/1962 | Czapar | 15/23 |

*Primary Examiner*—Robert W. Jenkins
*Assistant Examiner*—Arthur D. Dahlberg
*Attorney, Agent, or Firm*—Richards, Harris & Medlock

[57] ABSTRACT

A brush (10) is provided. The brush (10) includes a housing (12) which includes an aperture (28). Bristles (42) are mounted within the housing (12) and extend through the aperture (28). A cover (50) is provided and includes an aperture (52). Cover (50) is slidably mounted to the housing (12) and housing (12) is selectively rotatable within the cover (50). Housing (12) is rotatable to a first position exposing bristles (42) through the aperture (52) of the cover (50) for use of the brush (10). Housing (12) is rotatable to a second position for covering the aperture (28) and the bristles (42) when the brush (10) is not in use.

8 Claims, 4 Drawing Figures

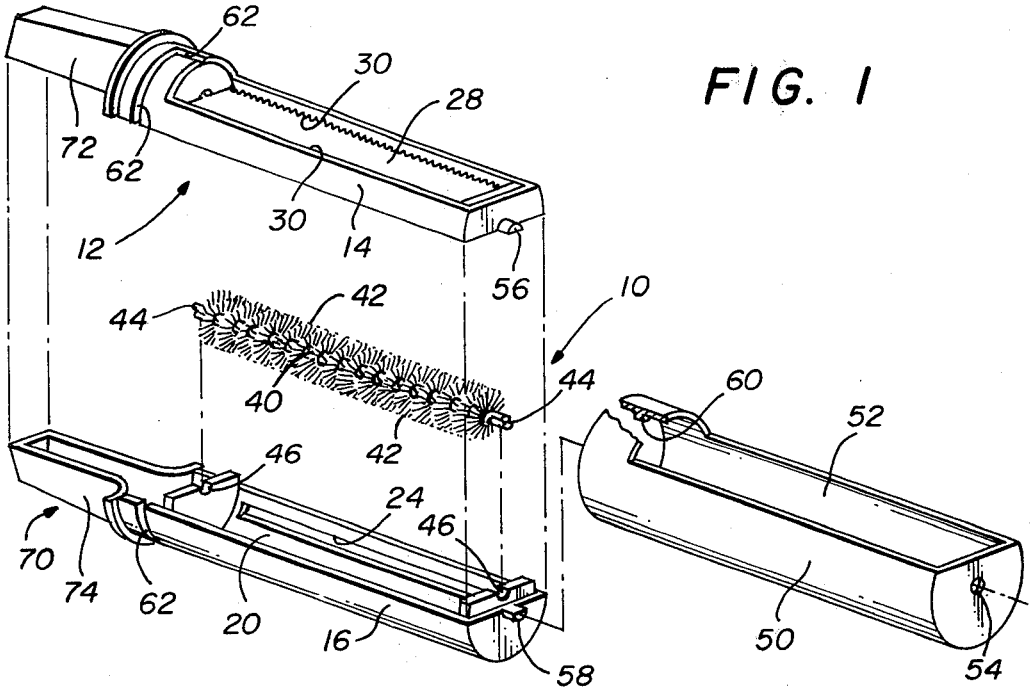
FIG. 1
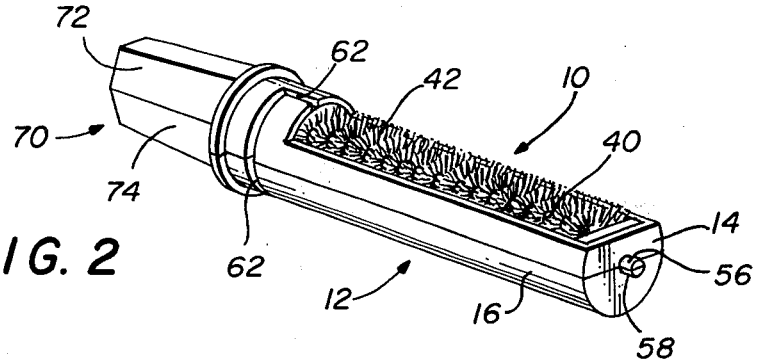
FIG. 2
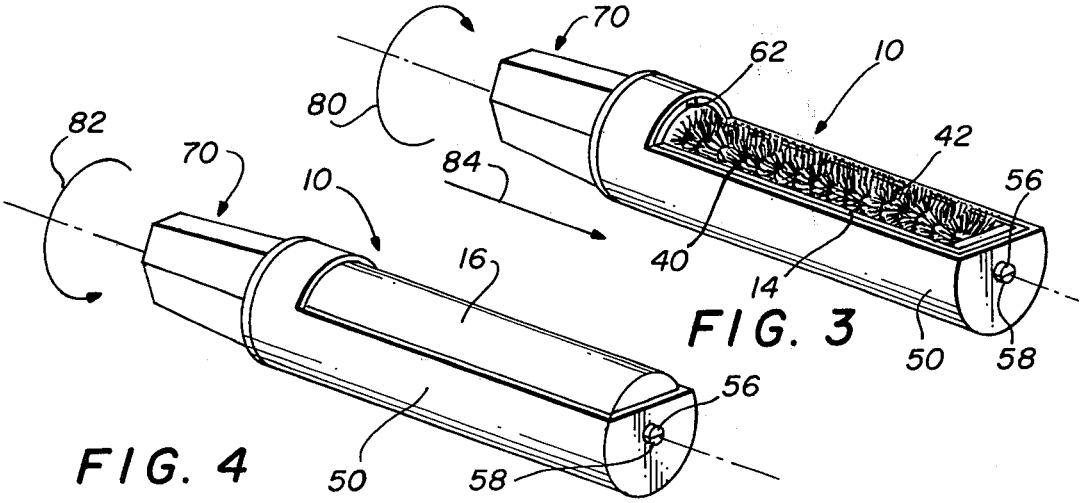
FIG. 3
FIG. 4

PORTABLE POCKET CLOTHES BRUSH

TECHNICAL FIELD

This invention relates to brushes, and more particularly to a portable clothes brush.

BACKGROUND ART

Numerous portable brushes have been provided in which a bristle member is adjusted to a fully concealed position within a housing or in which the bristle member is fully contained within a housing such that the bristle member or brush is concealed when not in use. Such brushes are adaptable to be conveniently carried about a person, for example, in a pocket or in a handbag and useable for a variety of purposes. These purposes include grooming, clothes brushes for removing lint and other debris, shoe brushes and the like. A principle benefit of such brushes is their compact construction and ease of operation.

Previously developed portable brushes have required numerous components and complex actuating mechanisms. Furthermore, the construction of such prior brushes has required strict adherence to close manufacturing tolerances. This requirement of close manufacturing tolerances has a direct bearing upon the reliability and life of such portable brushes. The number of components and complexity of actuation, additionally, has a direct bearing on the wear of the brush components. Furthermore, previously developed brushes have not provided for a receptacle to collect debris cleaned from an article, such as, for example, clothing, but permit the debris to be merely moved from one place to another and not removed from the article of clothing.

A need has thus arisen for a brush that has a minimum number of components and which is simple to actuate to ensure a reliable product and one which is maintenance free. A need has further arisen for a brush that is easy to manufacture in that manufacturing tolerances are not critical. A need has further arisen for a clothes brush which is provided with structure for collecting debris removed from clothing. A need has further arisen for a brush that is compact and relatively inexpensive to manufacture.

DISCLOSURE OF THE INVENTION

In accordance with the present invention, a clothes brush is provided which substantially eliminates the problems heretofore associated with such brushes.

In accordance with the present invention, a brush is provided which includes a housing having an aperture. Bristles are mounted within the housing and extend through the aperture. A cover is provided which includes an aperture. The cover is slidably mounted to the housing, such that the housing is selectively rotatable within the cover to a first position exposing the bristles through the cover aperture for use of the brush. The housing is further rotatable to a second position for covering the housing aperture and the bristles when the brush is not in use.

In accordance with yet another aspect of the present invention, a brush is provided which includes a housing having a recess for retaining debris collected by the brush. The housing further includes an aperture communicating with the recess. The bristles are rotatably mounted within the housing and extend through the housing aperture. The housing further includes a slot communicating with the recess to permit emptying of debris collected by the bristles from the recess. A cover is provided and includes an aperture. The cover is slidably mounted to the housing. The housing is selectively rotatable within the cover to align the housing aperture with the cover aperture for exposing the bristles through the cover for use of the brush. The housing is also selectively rotatable to misalign the housing aperture and the cover aperture for covering the bristles when the brush is not in use. The housing slot is covered by the cover in both the use and nonuse positions of the brush.

In accordance with still another aspect of the present invention, a brush is provided which includes a cylindrical housing having a semi-cylindrical recess and an elongated aperture communicating with the semi-cylindrical recess. Bristles are disposed within the elongated aperture and are rotatably mounted for rotation within the semi-cylindrical recess and further extend through the elongated aperture of the housing. The cylindrical housing further includes a slot communicating with the semi-cylindrical recess through which debris collected by the bristles can be removed from the cylindrical housing. A plurality of teeth are disposed around the housing elongated aperture for selectively engaging the bristles for removing debris from the bristles and depositing the removed debris into the semi-cylindrical recess. A cylindrical cover is provided and includes an elongated aperture. The cylindrical cover is slidably mounted to the cylindrical housing for closing the slot of the housing to thereby retain debris within the semi-cylindrical recess. The cylindrical cover is selectively slidably removable to permit emptying of the debris from the semi-cylindrical recess. The cylindrical housing member is selectively rotatable within the cylindrical cover to align the cylindrical housing elongated aperture with the cylindrical cover elongated aperture for exposing the bristles through the cylindrical cover for use of the brush. The cylindrical housing is further selectively rotatable, such that the cylindrical cover closes the housing elongated aperture thereby preventing exposure of the bristles through the cylindrical cover when the brush is not in use.

BRIEF DESCRIPTION OF THE DRAWINGS

For a more complete understanding of the present invention and for further advantages thereof, reference is now made to the following Detailed Description, taken in conjunction with the accompanying Drawings in which:

FIG. 1 is an exploded perspective view of the present brush;

FIG. 2 is a perspective view of the assembled housing of the brush of the present invention illustrated in FIG. 1;

FIG. 3 is a perspective view of the assembled brush of the present invention in the open, use position; and FIG. 4 is a perspective view of the assembled brush of the present invention in the closed, nonuse position.

DETAILED DESCRIPTION

Referring simultaneously to FIGS. 1 and 2, the present brush is illustrated and is generally identified by the numeral 10. Brush 10 includes a housing generally identified by the numeral 12. Housing 12 is illustrated in FIG. 1 as composed of housing members 14 and 16. Housing members 14 and 16 are shown for illustrative purposes only, it being understood that housing 12 may be fabricated as a single unit depending upon material and fabrication techniques desired.

Housing member 16 includes a recess or receptacle 20 extending the length of housing member 16. Receptacle 20 functions to retain debris collected by brush 10. A slot 24 is provided within housing member 16 of brush 10 which communicates with receptacle 20. Slot 24 enables the emptying of debris collected and retained within receptacle 20 as will subsequently be described.

Housing member 14 includes an aperture 28 which extends along the length of housing 12 and lies above receptacle 20 of housing member 16. Disposed adjacent aperture 28 of housing member 14 are a plurality of teeth 30.

Positioned within aperture 28 and partially extending within receptacle 20 is a bristle carrier 40 having a plurality of bristles 42. Bristle carrier 40 is mounted between housing members 14 and 16 of housing 12 for rotatable movement therein. Bristle carrier 40 includes pins 44 which are rotatably supported in slots 46 of housing member 16. As bristle carrier 40 rotates, bristles 42 contact teeth 30, such that teeth 30 act as a comb to remove debris collected by bristles 42 as bristle carrier 40 rotates within housing 12. The removed debris is deposited within receptacle 20 of housing member 16.

Brush 10 further includes a cover generally identified by the numeral 50. Cover 50 includes an aperture 52 which when cover 50 is assembled to housing 12, allows bristles 42 to be exposed through cover 50 for operation of brush 10. Cover 50 is slidable over housing 12 and permits housing 12 to rotate within cover 50 to the open and closed position of brush 10.

Cover 50 includes an aperture 54 which receives a pin 56 integral with housing member 14 and a pin 58 integral with housing member 16. Pins 56 and 58, together with aperture 54 maintain cover 50 aligned with housing 12 of brush 10. Further included in cover 50 is a pin 60 which when cover 50 is assembled to housing 12, lies within a slot 62 disposed within housing member 14. The interaction between pin 60 and slot 62 prevents housing 12 from rotating to a position in which slot 24 aligns with aperture 52 of cover 50 to thereby prevent debris collected within receptacle 20 from being inadvertently emptied from brush 10.

Brush 10 further includes a handle generally identified by the numeral 70. Handle 70 is composed of handle members 72 and 74. By rotation of handle 70, housing 12 is rotatable within cover 50 to the open and closed positions of brush 10.

Referring simultaneously to FIGS. 3 and 4, the operation of the present brush 10 will now be described. In the open position, as illustrated in FIG. 3, aperture 28 of housing member 14 is aligned with aperture 52 of cover 50 to expose bristles 42 through cover 50. Bristles 42 can then be swept over the article to be brushed such as, for example, clothing, in a sweeping motion to collect debris found on the clothing. The sweeping action of brush 10 provides an effective and efficient brush for the collection of debris from clothing. The debris collected by bristles 42 is then deposited into receptacle 20 (FIG. 1) of housing member 16. Bristles 42 are cleaned through operation of teeth 30 (FIG. 1) which operates to comb bristles 42 of the collected debris.

An important aspect of the present invention is the rotatable feature of housing 12 within cover 50. As illustrated in FIGS. 3 and 4, by rotating handle 70 180° in the direction of arrow 80, (FIG. 3) housing member 16 rotates such that aperture 52 of cover 50 is closed to prevent exposure of bristles 42 (FIG. 4). In this manner, bristles 42 can be kept clean and covered when brush 10 is not in use. Further, when covered, bristles 42 are maintained relatively damage free which ensures a long life and continued use of brush 10. To return brush 10 from the closed position as illustrated in FIG. 4 to the open position as illustrated in FIG. 3, handle 70 is rotated 180° in the direction of arrow 82 (FIG. 4).

Rotation of housing 12 within cover 50 is limited by pin 60 contacting the end of slot 62 which thereby prevents slot 24 from aligning with aperture 52 of cover 50. Slot 62 extends for approximately 180° around housing 12 as illustrated in FIG. 2. In this manner, debris collected by bristles 42 is retained within receptacle 20 of housing member 16 (FIG. 1). To remove the collected debris from receptacle 20, housing 12 is removed from cover 50 in the direction indicated by arrow 84 (FIG. 3), and the collected debris can be removed through the now exposed slot 24.

Brush 10 may be fabricated from numerous plastic materials. For example, housing 12 and cover 50 may be formed from high impact styrene material. Bristles 42 of bristle carrier 40 may be formed from, for example, polypropylene material, nylon, natural hair or the like. Brush 10 is compact in size and may have an overall length of approximately 3.5 inches and a diameter of approximately 0.8 inches.

It therefore can be seen that the brush of the present invention provides for a portable compact clothes brush which can be easily stored in one's pocket or a handbag. The brush of the present invention further includes a receptacle for retaining collected debris and a cover for covering the bristles of the brush when not in use. The present brush is easy to operate and has a minimum number of components to ensure reliability, long life and ease in manufacture.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A brush comprising:

a housing having an aperture;

bristle means mounted within said housing and extending through said aperture;

said housing further having an elongated slot to facilitate emptying of said housing of debris collected by said bristle means;

cover means including an aperture, said cover means being mounted to said housing, said housing being selectively rotatable within said cover means to a first position exposing said bristle means through said aperture of said cover means for use of the brush and said housing being rotatable to a second position for covering said housing aperture and said bristle means when the brush is not in use; and means for preventing said housing from rotating to prevent said elongated slot from aligning with said aperture of said cover means.

2. The brush of claim 1 wherein said housing further includes:

a plurality of teeth disposed adjacent said housing aperture and contacting said bristle means for cleaning said bristle means.

3. The brush of claim 1 and further including:

handle means extending from said housing for rotating said housing within said cover means.

4. A brush comprising:

a housing having a recess for retaining debris collected by the brush;

said housing further including an aperture communicating with said recess;

bristle means rotatably mounted within said housing and extending through said housing aperture;

said housing further including a slot communicating with said recess to permit emptying of debris collected by said bristle means from said recess;

cover means including an aperture, said cover means being mounted to said housing, said housing being selectively rotatable within said cover means to align said housing aperture with said cover means aperture for exposing said bristle means through said cover means for use of the brush and said housing being selectively rotatable to misalign said housing aperture and said cover means aperture for covering said bristle means when the brush is not in use, said housing slot being covered in both said use and nonuse positions; and means for preventing said housing from rotating to prevent said slot from aligning with said aperture of said cover means.

5. The brush of claim 4 and further including:

a plurality of teeth disposed adjacent said housing aperture and contacting said bristle means for cleaning said bristle means.

6. A brush comprising:

a cylindrical housing member having a semi-cylindrical recess and an elongated aperture communicating with said semi-cylindrical recess;

bristle means disposed within said elongated aperture of said housing member and being rotatably mounted for rotation within said semi-cylindrical recess and extending through said elongated aperture of said housing member;

said cylindrical housing member further having a slot communicating with said semi-cylindrical recess through which debris collected by said bristle means can be removed from said cylindrical housing member;

a plurality of teeth disposed around said housing member elongated aperture for selectively engaging said bristle means for removing debris from said bristle means and for depositing said removed debris into said semi-cylindrical recess of said cylindrical housing member;

a cylindrical cover member including an elongated aperture and being slidably mounted to said cylindrical housing for closing said slot of said housing member to thereby retain debris within said semi-cylindrical recess, said cylindrical cover member being selectively slidably removable to permit emptying of debris from said semi-cylindrical recess; and said cylindrical housing member being selectively rotatable within said cylindrical cover member to align said cylindrical housing member elongated aperture with said cylindrical cover member elongated aperture for exposing said bristle means through said cylindrical cover member for use of the brush, and said cylindrical housing member being selectively rotatable, such that said cylindrical cover member closes said housing elongated aperture thereby preventing exposure of said bristle means through said cylindrical cover member when the brush is not in use.

7. The brush of claim 6 and further including:

means for preventing rotation of said cylindrical housing member to prevent alignment of said slot and said cylindrical cover member elongated aperture.

8. The brush of claim 6 and further including:

handle means extending from said cylindrical housing member for rotating said cylindrical housing member within said cylindrical cover member.

* * * * *